US006844556B2

(12) United States Patent
Kinoyama

(10) Patent No.: US 6,844,556 B2
(45) Date of Patent: Jan. 18, 2005

(54) ION SOURCE, METHOD OF OPERATING THE SAME, AND ION SOURCE SYSTEM

(75) Inventor: Toshiaki Kinoyama, Kyoto (JP)

(73) Assignee: Nissin Electronics Co., Ltd., Kyoto (JP)

( * ) Notice: Subject to any disclaimer, the term of this patent is extended or adjusted under 35 U.S.C. 154(b) by 24 days.

(21) Appl. No.: 10/442,283

(22) Filed: May 21, 2003

(65) Prior Publication Data

US 2003/0218429 A1 Nov. 27, 2003

(30) Foreign Application Priority Data

May 24, 2002 (JP) ..... 2002-150659

(51) Int. Cl.[7] ..... H01J 27/00; H01J 7/24

(52) U.S. Cl. ..... 250/425; 250/289; 250/423 R; 315/111.81

(58) Field of Search ..... 250/289, 423 R, 250/425; 315/111.81, 111.91

(56) References Cited

U.S. PATENT DOCUMENTS 6,288,403 B1 9/2001 Horsky et al. ..... 250/427
6,452,338 B1 9/2002 Horsky ..... 315/111.81
2003/0085663 A1 * 5/2003 Horsky ..... 315/111.81

FOREIGN PATENT DOCUMENTS

| | | |
|---|---|---|
| JP | 01-98469 | 6/1989 |
| JP | 2000-243308 | 9/2000 |
| JP | 2001-135253 | 5/2001 |
| WO | WO 01/43157 A1 | 6/2001 |

* cited by examiner

*Primary Examiner*—Tuyet Thi Vo
(74) *Attorney, Agent, or Firm*—Finnegan, Henderson, Farabow, Garrett & Dunner, L.L.P.

(57) ABSTRACT

In an ion source, within a support body which supports a plasma production chamber for producing a plasma on the basis of an ion source flange, a cavity is provided ranging from a position near the plasma production chamber to a position near the ion source flange. The cavity serves as a cooling medium passage which introduces a cooling medium to a position near the plasma production chamber to cool the plasma production chamber. The plasma production chamber is cooled at a position very near it by the cooling medium. Therefore, temperature of the plasma production chamber at the time of plasma production is kept at low temperatures.

4 Claims, 4 Drawing Sheets

ION SOURCE, METHOD OF OPERATING THE SAME, AND ION SOURCE SYSTEM

BACKGROUND OF THE INVENTION

1. Field of the Invention

The present invention relates to an ion source which produces a plasma and extracts an ion beam from the produced plasma, a method of operating the ion source and an ion source system having the ion source. More particularly, the present invention relates to means for keeping temperature of a plasma production chamber for producing the plasma at low temperatures at the time of plasma production and means for operating the ion source selectively in a low temperature operation mode and a high temperature operation mode for the plasma production chamber.

2. Description of the Related Art

FIG. 4 shows an example of a related art ion source. An ion source 2 comprises a plasma production section 4 which ionizes ion species such as a gas or vapor introduced into the plasma production section 4 to produce a plasma 14. The plasma production section 4 is supported by a plurality (usually 4) of bar-like supporting members (support poles in this instance) on the basis of an ion source flange 36.

The ion source flange 36 is used for mounting the ion source 2 on a vacuum chamber which is called anion source chamber. A vacuum atmosphere is produced on an inner side of the ion source flange 36 (the plasma production section 4 side when the ion source 2 is mounted onto the vacuum chamber). The ion source flange 36 includes packings 38 for vacuum sealing, and has a water-cooling structure for cooling and protecting the packings 38.

The plasma production section 4 is called Bernas-type in this instance, and includes a plasma production chamber 6 for producing the plasma 4 therein, a filament 10 for emitting electrons and a reflector 12 for reflecting electrons. The plasma production chamber 6 has an ion-extracting aperture 8. The filament 10 and the reflector 12 are oppositely disposed within the plasma production chamber 6. The plasma production section 4 may be of another type, for example, a Freeman type which includes a bar-like filament. An ion beam 16 can be extracted from the plasma production section 4 (exactly, the plasma production chamber 6) under an electric field.

A material gas 20 as ion species (also called an ionizable material: The same shall apply hereinafter.) may be introduced into the plasma production chamber 6 via a gas introducing pipe 18, in this instance. The ion source 2 includes a vapor generating chamber (oven) 22 which heats a solid material 26 by a heater 28 to vaporize it into a vapor 24. The vapor 24 generated from the solid material 26 can also be introduced as ion species into the plasma production chamber 6 via a nozzle 23. The vapor generating oven 22 is supported by the ion source flange 36 through a support part 30 and an oven flange 32.

The plasma production chamber 6 is heated to high temperatures, for example, several hundreds ° C. to 1000° C., with production of the plasma 14. Such a heating of the chamber is caused by heat generated from the filament 10 and heat by an arc discharge generated between the filament 10 and the plasma production chamber 6.

The ion source flange 36 is cooled to have low temperature of about room temperature for protecting the packings 38, etc., as described above.

To cope with this, a related art technique uses a plurality of bar-like supporting members (support poles) 34 in order that the plasma production chamber 6 is mechanically supported by the ion source flange 36, and thermal conduction from the plasma production chamber 6 to the ion source flange 36 is kept low, while the plasma production chamber 6 is kept at high temperatures.

In a case where the ion species constituting the material gas 20 and the vapor 24 is a material of a high melting point, such as indium, indium fluoride or antimony, it is preferable to keep the plasma production chamber 6 at high temperature. Accordingly, no problem arises in the related art structure stated above. In the case of ion species, such as phosphorous and arsenic, for which the plasma production chamber is preferably kept at medium temperatures, the related art structure creates no problem.

In a case where the ion species constituting the material gas 20 and the vapor 24 is a material of which the melting point and sublimation point are low and which will undergo thermal dissociation of molecule at high temperatures, such as decaborane ($B_{10}H_{14}$), the following problem arises. When the plasma production chamber 6 is heated to have a high temperature at the time of plasma production, the number of decaborane ions in the produced plasma becomes small while the number of dissociation molecule ion, such as pentaboran ions or octaborane ions in the produced plasma becomes larger. Thus, the decaborane ion beam with a predetermined amount cannot be extracted.

Such a problem occurs not only when where the material gas 20 is introduced from the gas introducing pipe 18 but also when the vapor generating oven 22 is operated to generate the vapor 24. The reason for this is that the vapor generating oven 22 and the plasma production chamber 6 are connected by the nozzle 23. Hence, temperature of the vapor generating oven 22 increases undesirably due to the thermal conduction from the plasma production chamber 6 even if the current fed to the heater 28 of the vapor generating oven 22 is reduced or stopped. The temperature of vapor generating oven 22 also increases undesirably due to heat radiated from the plasma production chamber 6.

When the decaborane is used for the ion species, a large current beam of low energy is equivalently produced by utilizing the feature of the cluster ion beam, and ion beam irradiation (for example, ion injection) with less charge-up of the substrate is advantageously obtained. However, when the decaborane is used for the ion species, in particular temperature of the plasma production chamber 6 at the time of plasma production must be kept low. It must be kept at a temperature value below a range from room temperature to about 100° C., for example. However, it is almost impossible for the related art ion source 2 to achieve such low temperatures of the plasma production chamber 6.

SUMMARY OF THE INVENTION

Accordingly, an object of the present invention is an ion source which can keep the temperature of a plasma production chamber at the time of plasma production at low temperatures, a method of operating the ion source and an ion source system having the ion source.

Another object of the present invention is to enable the ion source to operate selectively in an operation mode in which temperature of the plasma production chamber is relatively low at the time of plasma production or another operation mode in which temperature of the plasma production chamber is relatively high at the time of plasma production.

In order to accomplish the object above, the following means are adopted. According to the present invention, there is provided an ion source comprising: a plasma production chamber for producing a plasma; a vapor generating chamber for vaporizing a solid material disposed therein to generate a vapor; and a support body for supporting the plasma production chamber on the basis of an ion source flange, the support body having a cooling medium passage for cooling the plasma production chamber and the vapor generating chamber by a cooling medium flowing the cooling medium passage.

In the ion source, the plasma production chamber and the vapor generating chamber are cooled by a cooling medium flowed to the cooling medium passage provided in the support body. Therefore, temperature of the plasma production chamber and temperature of the vapor generating chamber at the time of plasma production is kept at low temperatures.

In the ion source, the support body may have a double-tubular structure including a space provide data central part of the support body and a cavity provided in an interior of the support body so as to surround the space, the cavity serving as the cooling medium passage, and the vapor generating chamber is disposed in the space.

The ion source may further comprises a cooling medium supplying pipe for introducing the cooling medium to the cavity, wherein the cavity is formed ranging from a position near the plasma production chamber to a position near the ion source flange and the cooling medium supplying pipe is inserted into the cavity in such a manner that a tip end of the cooling medium supplying pipe is disposed near the plasma production chamber.

To achieve the above-mentioned object, a method of operating an ion source according to the present invention, the ion source comprising a plasma production chamber for producing a plasma and a support body which supports the plasma production chamber on the basis of an ion source flange and has a cavity provided ranging from a position near the plasma production chamber to a position near the ion source flange in an interior of the support body, comprises: operating the ion source selectively in a cooling mode in which a cooling medium is flowed into the cavity of the support body, or in a evacuating mode for carrying out a vacuum-evacuation of the cavity of the support body.

According to the ion source operating method, in the cooling mode, the plasma production chamber is cooled by a cooling medium flowed to the cooling medium passage in the support body. Therefore, the ion source is operated in a state that temperature of the plasma production chamber is relatively low. In the evacuating mode, the thermally insulating effect of the support body is enhanced in a manner that the vacuum-evacuation of the cavity in the support body is carried out and the resulting vacuum insulating operation in the cavity is utilized. Therefore, the ion source is operated in a state that temperature of the plasma production chamber is relatively high. Here, the word "relatively" means "relative to the temperature in the other mode".

Where the ion source is thus operated selectively in the cooling mode or the evacuating mode, one ion source may be used over a broad range of the temperature of the plasma production chamber. Accordingly, freedom of selecting ion species that may be used is considerably increased.

The ion source operating method may further comprises operating the ion source in a purging mode in which a nitrogen gas is supplied into the cavity of the support body, after the cooling mode.

Further, the invention also provides an ion source system comprises: an ion source having a plasma production chamber for producing a plasma, and a support body for supporting the plasma production chamber on the basis of an ion source flange, the support body having a cavity provided ranging from a position near the plasma production chamber to a position near the ion source flange in an interior of the support body; a cooling medium supplying device for flowing a cooling medium into the cavity of the support body of the ion source; a vacuum evacuating device for carrying out a vacuum-evacuation of the cavity of the support body of the ion source; and a selector for selectively and communicatively connecting the cavity of the support body of the ion source to the cooling medium supplying device or the vacuum evacuating device.

In the ion source system, the ion source is operable selectively in an operation mode in which the cooling medium is flowed from the cooling medium supplying device to the cavity of the support body (cooling mode), or in another operation mode in which the vacuum-evacuation is carried out for the cavity by the vacuum evacuating device (evacuating mode). One ion source 2*a* may be used over a broad range of the temperature of the plasma production chamber. Accordingly, freedom of selecting ion species that may be used is considerably increased.

The ion source system may further comprise a nitrogen gas source for supplying a nitrogen gas into the cavity of the support body of the ion source.

DETAILED DESCRIPTION OF THE INVENTION

Figure 1:
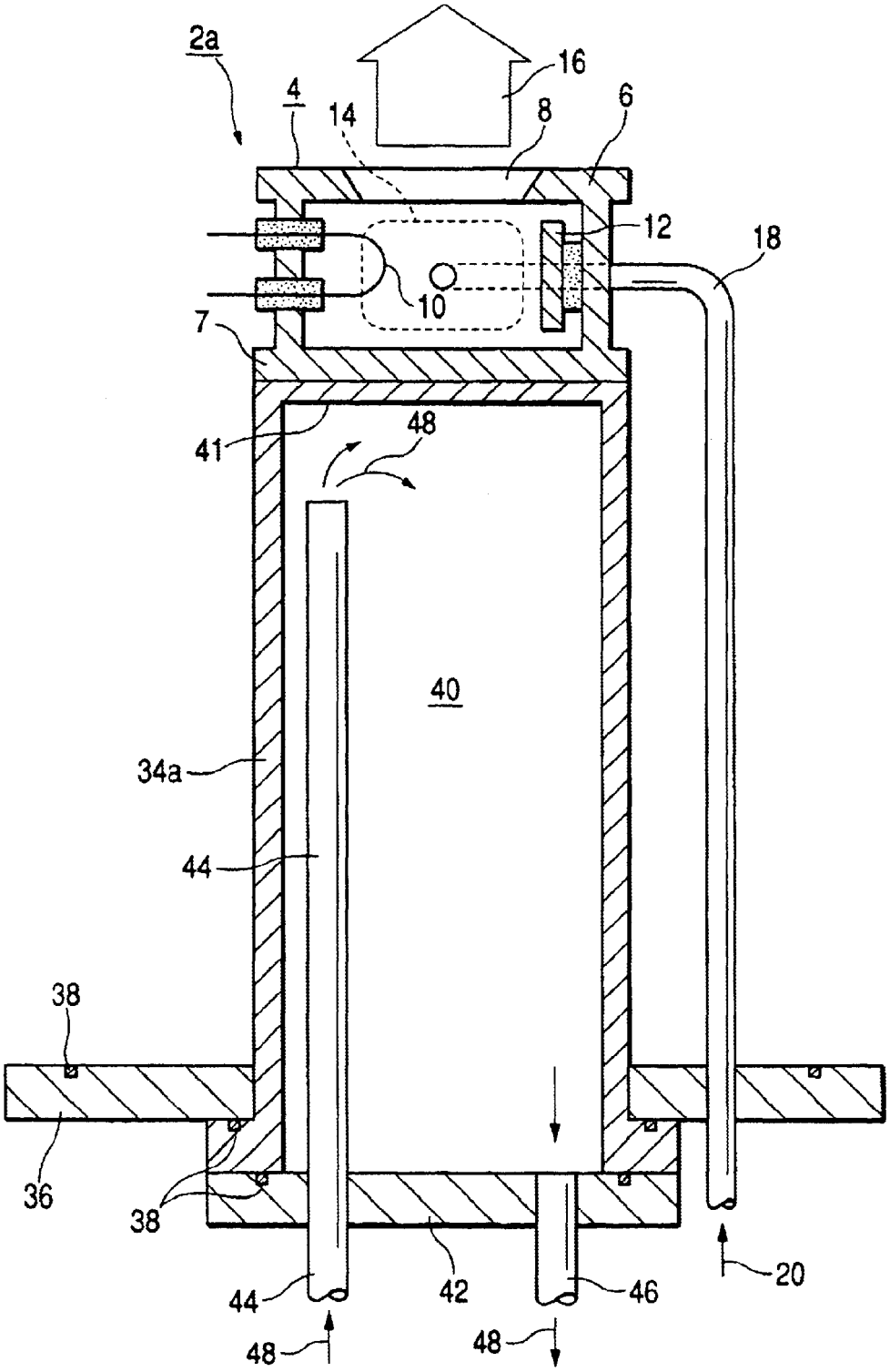
FIG. 1 is a cross sectional view showing an ion source according to a first embodiment of the present invention.
Figure 4:
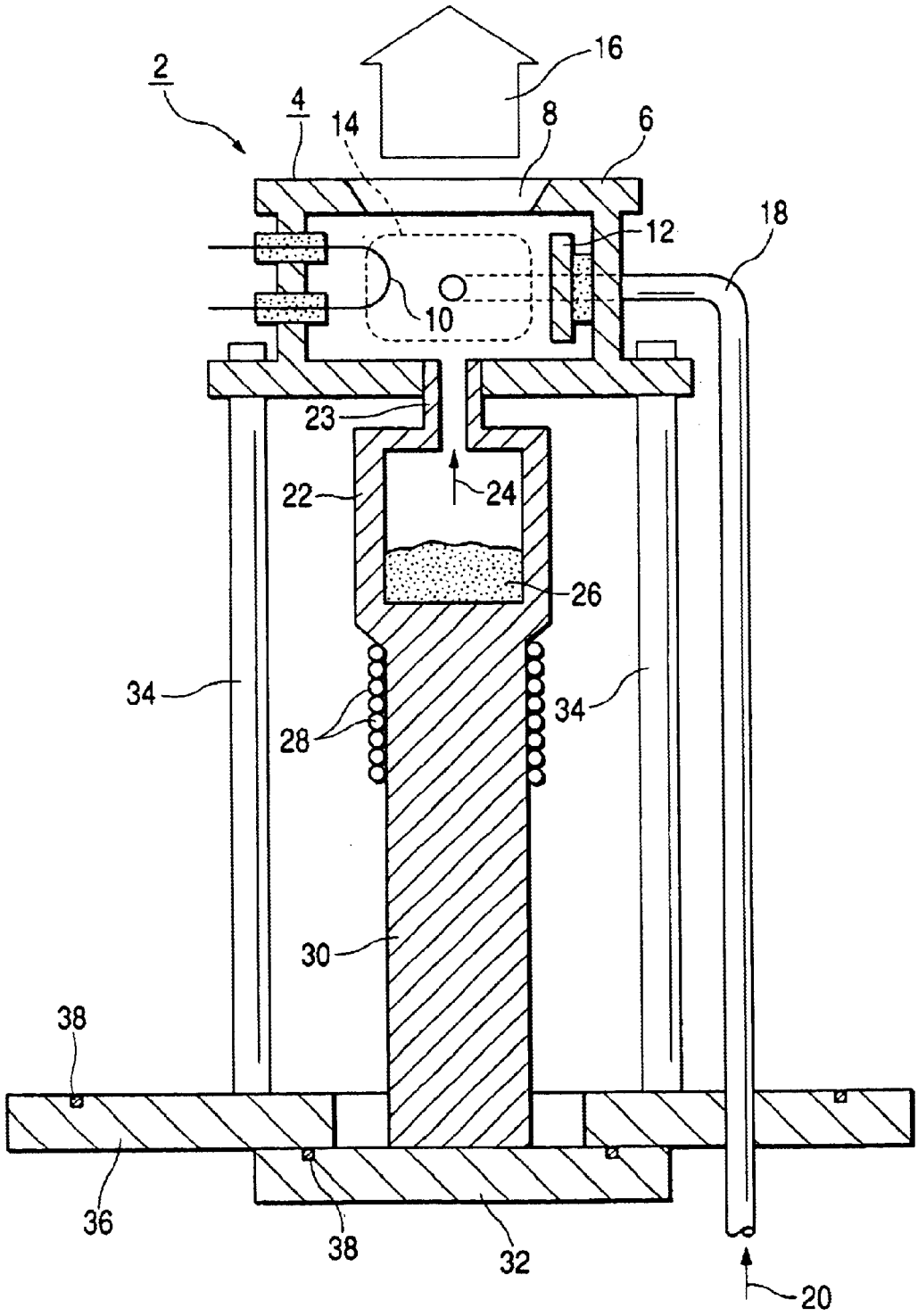
FIG. 4 is a cross sectional view showing a related art ion source.

FIG. 1 is a cross sectional view showing an ion source according to a first embodiment of the present invention. Like or equivalent portions are designated by like reference numerals used in the related art example shown in FIG. 4, for simplicity. Description will be given placing emphasis mainly on the differences of the ion source from the related art example.

An ion source 2*a* is equipped with a gas introducing pipe 18, but is not equipped with a vapor generating oven. A support body 34*a* corresponds to the support members 34 shown in Fog. 4. The support body 34*a* supports a plasma production chamber 6 of a plasma production section 4 on the basis of an ion source flange 36. Within the support body 34*a*, a cavity 40 is provided ranging from a position near the plasma production chamber 6 to a position near the ion source flange 36. More specifically, the support body 34*a* is a tubular body with a bottom surface 41 where the cavity 40 is provided in an interior of the support body 34*a*. A lid 42 is applied to an opening of the support body 34*a*, which is located outside the ion source flange 36 in a longitudinal direction of the support body 34*a*. Joining parts of the respective members are sealed for securing vacuum and for cooling medium confinement by packings 38 (The same thing applies to an embodiment of FIG. 2).

A cooling medium 48 is flowed through the cavity 40 by cooling medium supplying and evacuating means, which contains a cooling medium supplying pipe 44 and a cooling medium evacuating pipe 46 in this instance. The cavity 40 serves as a cooling medium passage which introduces the cooling medium 48 to a position near the plasma production chamber 6 to cool the plasma production chamber 6. Preferably, the cooling medium supplying pipe 44 is inserted into the cavity 40 so that a tip end of the pipe 44 can be positioned near the upper part of the cavity 40, viz., near the plasma production chamber 6, as in this instance. If so done, the cooling medium 48 introduced into the cavity 40 is efficiently supplied to a position near the plasma production chamber 6, whereby the plasma production chamber 6 is efficiently cooled.

The cooling medium 48 is cooling water at room temperature, for example, and if necessary, may be another suitable cooling medium. For selection of temperature, flow rate, kind and the like of the cooling medium 48, it is satisfactory to select them so that the plasma production chamber 6 has a desired temperature at the time of plasma production. When the ion source 2*a* is operated, high voltage (to extract an ion beam 16) is applied to the ion source flange 36, the support body 34*a* and the plasma production chamber 6. Therefore, there is a possibility that those components are electrically connected to a ground potential part through the cooling medium 48. To avoid this or for other reasons, pure water having high electrical resistance is preferably used for the cooling medium 48.

In the ion source 2*a*, the plasma production chamber 6 is cooled at a position very near it by the cooling medium 48 flowing through the cavity 40 (cooling medium passage) provided within the support body 34*a*. Therefore, temperature of the plasma production chamber 6 at the time of plasma production is kept at low temperatures. By using the cooling water at room temperature for the cooling medium 48, the plasma production chamber 6 is kept at a temperature value within a range from room temperature to several tens ° C., about 100° C. or lower at the highest.

Even if ion species constituting the material gas 20 to be introduced from the gas introducing pipe 18 into the plasma production chamber 6 is a material whose melting point and sublimation point are low, or even if the material gas 20 contains the decaborane, a density of the produced plasma 14 and further an amount of extracted ion beam 16 can be controlled to have a target value.

The support body 34*a* may be square (viz., a square-pillar like body) or circular (viz., a cylindrical body) in cross section (when viewing the support body 34*a* from the upper side in FIG. 1). The bottom surface 41 of the support body 34*a* and a bottom surface 7 of the plasma production chamber 6 may be constructed such that those surfaces 41 and 7 are separately formed and can be separated from each other. Alternatively, they maybe constructed such that those surfaces are integrally formed, and it serves as both the bottom surfaces for the plasma production chamber 6 and the support body 34*a*. The same thing applies to a second embodiment of FIG. 2 to be described later.

The ion source 2*a* may also be operated selectively in a cooling mode in which the cooling medium 48 is flowed into the cavity 40 of the support body 34*a* as described above, or in a evacuating mode for carrying out the vacuum-evacuation of the cavity 40. The vacuum-evacuation of the cavity 40 can be carried out via the cooling medium supplying pipe 44 and the cooling medium evacuating pipe 46.

The operation and its related effects of the ion source when it is operated in the cooling mode are described above.

In the evacuating mode, the thermally insulating effect of the support body 34*a* is enhanced in a manner that the vacuum-evacuation of the cavity 40 in the support body 34*a* is carried out and the resulting vacuum insulating operation in the cavity 40 is utilized. Accordingly, this mode is suitable for a case where the ion source is operated in a state that temperature of the plasma production chamber 6 (for example, several hundreds ° C. to about 1000° C.) is higher than that in the cooling mode.

Where the ion source is thus operated selectively in the cooling mode or the evacuating mode, one ion source 2*a* may be used over a broad range of the temperature of the plasma production chamber 6. Accordingly, freedom of selecting ion species that may be used is considerably increased. In other words, one ion source 2*a* is operable for a variety of ion species including those whose melting point and sublimation point are low to those whose melting point and sublimation point are high.

In a case where the ion source 2*a* is operated only in the cooling mode, the following construction may be used. The cavity 40 is provided at least near the plasma production chamber 6 within the support body 34*a*, and a cooling medium 48 is flowed through the cavity 40 by use of cooling medium supplying/evacuating means, such as cooling medium passing pipe and cooling medium passing groove. The object of cooling the plasma production chamber 6 may be achieved by such a construction. The same thing applies to an ion source 2*a* of FIG. 2 to be described later.

Figure 2:
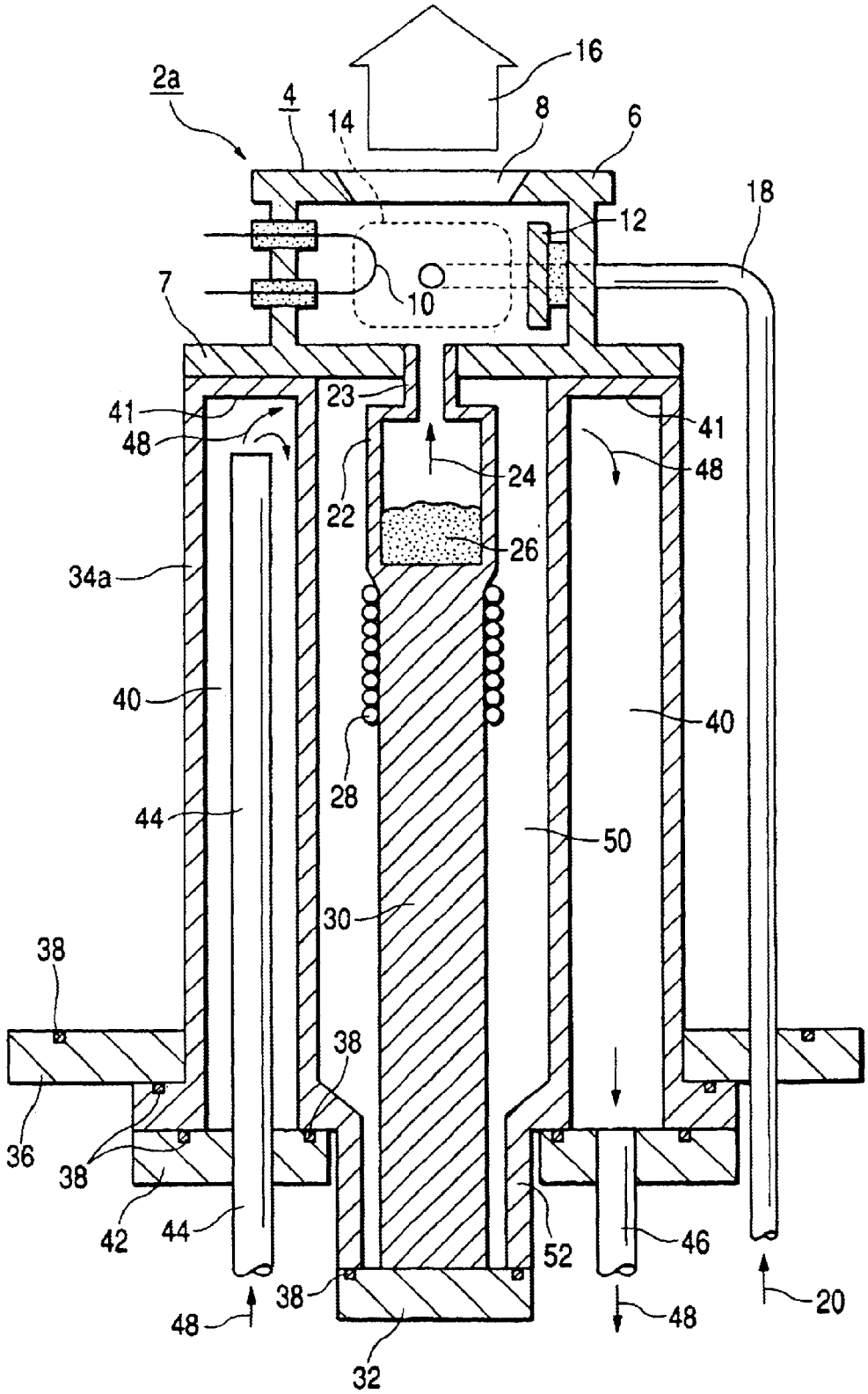
FIG. 2 is a cross sectional view showing an ion source according to a second embodiment of the present invention.

FIG. 2 is a cross sectional view showing an ion source according to a second embodiment of the present invention. An ion source 2*a* of the second embodiment includes a vapor generating oven 22 in addition to the gas introducing pipe 18. Description will be given mainly about differences of the second embodiment from the first embodiment shown in FIG. 1.

In the ion source 2*a*, within a support body 34*a* for supporting a plasma production chamber 6 on the basis of an ion source flange 36, a cavity 40 is provided ranging from a position near the plasma production chamber 6 to a position near the ion source flange 36. A cooling medium supplying pipe 44 and a cooling medium evacuating pipe 46, which are similar to those of the already described embodiment, are connected to the cavity 40. The cooling medium supplying pipe 44 is inserted into the cavity 40 as in the above-mentioned embodiment. The support body 34*a* further includes a pillar-like space 50 located at the central part, and the vapor generating oven 22 as described above is placed in the space 50. In other words, the support body 34*a* of the second embodiment has a double-tubular structure including the space 50 provided at a central part of the support body and the cavity 40 provided in an interior of the support body so as to surround the space 50.

The vapor generating oven 22, as described above, is constructed such that a solid material 26 is heated by a heater 28 to generate a vapor 24, and the vapor 24 generated is introduced into the plasma production chamber 6 via a nozzle 23. An oven flange 32 supports the vapor generating oven 22 through a support part 30. The oven flange 32 is attached to an oven connection part 52 located outside an ion source flange 36 in a longitudinal direction of the support body 34*a*.

In the ion source 2*a*, as in the case of the ion source 2*a* of FIG. 1, by flowing the cooling medium 48 into the cavity 40 of the support body 34*a*, viz., by using the cavity 40 as a cooling medium passage, temperature of the plasma production chamber 6 may be kept at low temperatures at the time of plasma production. The operation and its related effects of the ion source are described above.

Further, the vapor generating oven 22 and the heater 28 are disposed within the space 50 of the support body 34*a* with the double-tubular structure and thus, the periphery of them can be cooled by the cooling medium 48 flowing the cavity 40. In other word, with this double-tubular structure of the support body 34*a*, the plasma production chamber 6, the vapor generating oven 22, the heater 28, and the support part 30 can be cooled by the cooling medium 48 flowing the cavity 40 so that the plasma production chamber 6 and the vapor generating oven 22 can be kept at low temperatures.

If this cooling operation and the heat by the heater 28 are used together, temperature of the vapor generating oven 22 can be controlled preciously even in the low temperature range (several tens ° C. to 100° C., for example). This becomes particularly effective when the decaborane is used as the solid material 26.

The ion source 2*a*, as in the case of the ion source 2*a* of FIG. 1, may also be operated selectively in a cooling mode in which the cooling medium 48 is flowed into the cavity 40 of the support body 34*a* or in a evacuating mode for carrying out the vacuum-evacuation of the cavity 40. The operation and its related effects of the ion source are described above.

Figure 3:
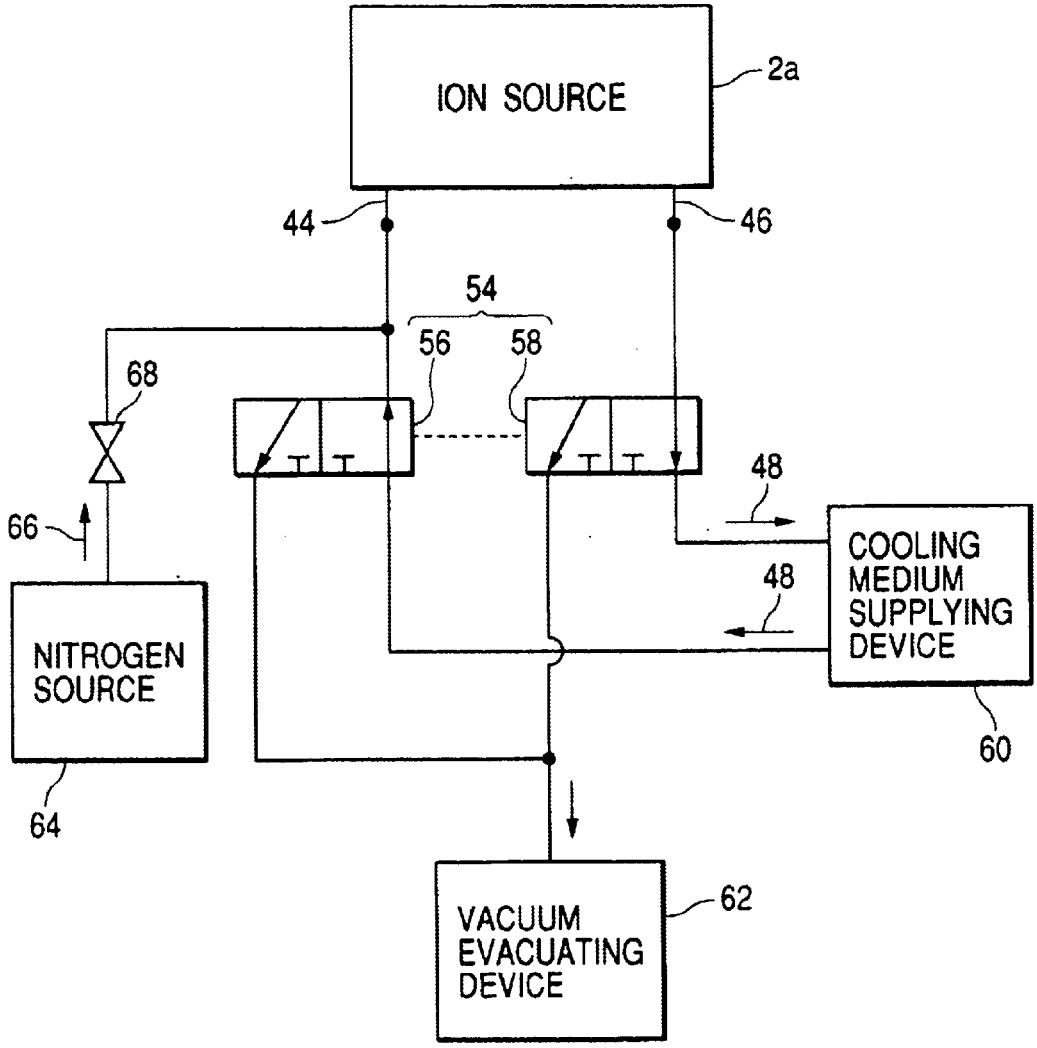
FIG. 3 is a diagram showing a pipe arrangement in an ion source according to the present invention.

An ion source system suitable for operating the ion source 2*a* selectively in the cooling mode or the evacuating mode is shown in FIG. 3.

An ion source system includes an ion source 2*a* as described referring to FIG. 1 or 2, a cooling medium supplying device 60, a vacuum evacuating device 62, and a selector 54. The cooling medium supplying device 60 flows a cooling medium 48 into a cavity 40 of a support body 34*a* of the ion source 2*a*. The vacuum evacuating device 62 carries out the vacuum-evacuation of the cavity 40 in the support body 34*a* of the ion source 2*a*. The selector 54 selectively connects the cavity 40 in the support body 34*a* of the ion source 2*a* communicatively to the cooling medium supplying device 60 or the vacuum evacuating device 62.

The cooling medium supplying device 60 is, for example, a water supplying device, preferably a pure-water supplying device.

In this instance, the selector 54 is formed by a two-position changeover valve 56 and another two-position changeover valve 58. The two-position changeover valve 56 selectively and communicatively connects the cooling medium supplying pipe 44 of the ion source 2*a* to the cooling medium supplying device 60 or the vacuum evacuating device 62. The two-position changeover valve 58 selectively and communicatively connects the cooling medium evacuating pipe 46 of the ion source 2*a* to the cooling medium supplying device 60 or the vacuum evacuating device 62. Those two-position changeover valves 56, 58 are operable in an interlocking manner, for example.

The ion source system includes a nitrogen gas source 64 and a valve 68. The nitrogen gas source 64 supplies a nitrogen gas 66 to the cavity 40 in the support body 34*a* of the ion source 2*a*, pipes connected thereto, and others, to thereby purge water out of there by the nitrogen gas. Incidentally, the nitrogen gas source and valve system is not essential to the invention.

An exemplar method of operating the ion source system will be described below.

1) When the ion source 2*a* is operated in the cooling mode:

The selector 54 is operated to connect the two-position changeover valves 56 and 58 to the cooling medium supplying device 60 to thereby flow the cooling medium 48 into the cavity 40 in the support body 34*a* of the ion source 2*a*.

2) When the ion source 2*a* is operated in the evacuating mode:

In a case where the preceding mode of the ion source 2*a* is the cooling mode, it is preferable to perform the purging operation by using the nitrogen gas. To the purging operation, the selector 54 is left set to the cooling medium supplying device 60, and the valve 68 is opened to supply the nitrogen gas 66 from the nitrogen gas source 64 to the cavity 40 of the support body 34*a*, pipes connected thereto and others, and move back the water left in the cavity, pipes and the like to the cooling medium supplying device 60. By so doing, there is no need for an excessive water evacuating operation. This leads to reduction of a time necessary for the subsequent vacuum-evacuation operation.

Thereafter, the selector 54 is operated to connect the two-position change over valves 56 and 58 to the vacuum evacuating device 62, and the vacuum-evacuation is carried out for the cavity 40 in the support body 34*a* of the ion source 2*a*, by the vacuum evacuating device 62.

The present invention, which is thus constructed, has the following advantages.

In the ion source, the plasma production chamber and/or the vapor generating chamber are cooled by a cooling medium flowed to the cooling medium passage provided in the support body. Therefore, temperature of the plasma production chamber and/or temperature of the vapor generating chamber at the time of plasma production are kept at low temperatures. Even if ion species to be introduced into the plasma production chamber is a material whose melting point and sublimation point are low, or even if it is a material which is likely to undergo thermal dissociation of molecule at high temperature, a density of the produced plasma and further an amount of extracted ion beam can be controlled to have a target value.

In the ion source operating method, in the cooling mode, the ion source is operated in a state that temperature of the plasma production chamber is relatively low. In the evacuating mode, the ion source is operated in a state that temperature of the plasma production chamber is relatively high. Where the ion source is thus operated selectively in the cooling mode or the evacuating mode, one ion source may be used over a broad range of the temperature of the plasma production chamber. Accordingly, freedom of selecting ion species that may be used is considerably increased.

In the ion source system, the ion source is operable selectively in an operation mode in which the cooling medium is flowed from the cooling medium supplying device to the cavity of the support body, or in another operation mode in which the vacuum-evacuation is carried out for the cavity by the vacuum evacuating device. One ion source may be used over a broad range of the temperature of the plasma production chamber. Accordingly, freedom of selecting ion species that may be used is considerably increased.

What is claimed is:

1. A method of operating an ion source comprising a plasma production chamber for producing a plasma and a support body which supports the plasma production chamber on the basis of an ion source flange and has a cavity provided ranging from a position near the plasma production chamber to a position near the ion source flange in an interior of the support body, the method comprising:

operating the ion source selectively in a cooling mode in which a cooling medium is flowed into the cavity of the support body, or in a evacuating mode for carrying out a vacuum-evacuation of the cavity of the support body.

2. The method of operating an ion source according to claim 1, further comprising:

operating the ion source in a purging mode in which a nitrogen gas is supplied into the cavity of the support body, after the cooling mode.

3. An ion source system comprising:

an ion source having a plasma production chamber for producing a plasma, and a support body for supporting the plasma production chamber on the basis of an ion source flange, the support body having a cavity provided ranging from a position near the plasma production chamber to a position near the ion source flange in an interior of the support body;

a cooling medium supplying device for flowing a cooling medium into the cavity of the support body of said ion source;

a vacuum evacuating device for carrying out a vacuum-evacuation of the cavity of the support body of said ion source; and a selector for selectively and communicatively connecting the cavity of the support body of said ion source to the cooling medium supplying device or the vacuum evacuating device.

4. The ion source system according to claim 3, further comprising:

a nitrogen gas source for supplying a nitrogen gas into the cavity of the support body of said ion source.

* * * * *

UNITED STATES PATENT AND TRADEMARK OFFICE

CERTIFICATE OF CORRECTION

PATENT NO. : 6,844,556 B2
DATED : January 18, 2005
INVENTOR(S) : Toshiaki Kinoyama It is certified that error appears in the above-identified patent and that said Letters Patent is hereby corrected as shown below:

Title page,
Item [73], Assignee, "Nissin Electronics" should read -- Nissin Electric --.

Signed and Sealed this

Twenty-first Day of June, 2005

JON W. DUDAS
*Director of the United States Patent and Trademark Office*